US010444651B2

(12) United States Patent
Takii et al.

(10) Patent No.: US 10,444,651 B2
(45) Date of Patent: Oct. 15, 2019

(54) CARRIER, DEVELOPER, SUPPLEMENTAL DEVELOPER, IMAGE FORMING APPARATUS, IMAGE FORMING METHOD, AND PROCESS CARTRIDGE

(71) Applicants: Mariko Takii, Kanagawa (JP); Koichi Sakata, Shizuoka (JP); Tohru Suganuma, Shizuoka (JP); Masahiro Seki, Shizuoka (JP); Masashi Nagayama, Shizuoka (JP); Toyoaki Tano, Shizuoka (JP); Kohsuke Miyazaki, Shizuoka (JP)

(72) Inventors: Mariko Takii, Kanagawa (JP); Koichi Sakata, Shizuoka (JP); Tohru Suganuma, Shizuoka (JP); Masahiro Seki, Shizuoka (JP); Masashi Nagayama, Shizuoka (JP); Toyoaki Tano, Shizuoka (JP); Kohsuke Miyazaki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/911,443

(22) Filed: Mar. 5, 2018

(65) Prior Publication Data

US 2018/0267421 A1 Sep. 20, 2018

(30) Foreign Application Priority Data

Mar. 17, 2017 (JP) ..... 2017-052864

(51) Int. Cl.
*G03G 9/107* (2006.01)
*G03G 9/113* (2006.01)
(Continued)

(52) U.S. Cl.
CPC ..... *G03G 9/1075* (2013.01); *G03G 9/1131* (2013.01); *G03G 9/1133* (2013.01);
(Continued)

(58) Field of Classification Search
CPC .. G03G 9/1075; G03G 9/1134; G03G 9/1136; G03G 15/0853; G03G 15/556; G03G 9/1131
See application file for complete search history.

(56) References Cited

U.S. PATENT DOCUMENTS 6,500,595 B1 12/2002 Mochizuki et al.
2005/0277046 A1 12/2005 Sawada et al.
(Continued)

FOREIGN PATENT DOCUMENTS

JP 54-155048 12/1979
JP 57-040267 3/1982
(Continued)

OTHER PUBLICATIONS

U.S. Appl. No. 15/568,947, filed Oct. 24, 2017, Koichi Sakata, et al.

*Primary Examiner* — Thorl Chea
(74) *Attorney, Agent, or Firm* — Oblon, McClelland, Maier & Neustadt, L.L.P.

(57) ABSTRACT

A carrier is provided including a core particle and a resin layer coating the surface of the core particle. The resin layer includes fine metal particles, and a detected metal element amount A obtained by X-ray photoelectron spectrometry of the surface of the carrier is in a range of 4.0 atomic %≤A≤20.0 atomic % and an average major-axis length B of the fine metal particle exposing from the resin layer is in a range of 100 nm≤B≤800 nm.

11 Claims, 2 Drawing Sheets

(51) Int. Cl.
*G03G 15/08* (2006.01)
*G03G 15/00* (2006.01)

(52) U.S. Cl.
CPC ..... *G03G 9/1134* (2013.01); *G03G 9/1135* (2013.01); *G03G 9/1136* (2013.01); *G03G 9/1139* (2013.01); *G03G 15/08* (2013.01); *G03G 15/0853* (2013.01); *G03G 15/556* (2013.01)

(56) References Cited

U.S. PATENT DOCUMENTS

| | | | | |
|---|---|---|---|---|
| 2006/0029433 | A1 | 2/2006 | Saito et al. | |
| 2007/0190444 | A1 | 8/2007 | Kotsugai et al. | |
| 2008/0213682 | A1 | 9/2008 | Saitoh et al. | |
| 2016/0327884 | A1 | 11/2016 | Nakajima et al. | |
| 2016/0363880 | A1* | 12/2016 | Takii ..... | G03G 9/1139 |
| 2017/0248871 | A1 | 8/2017 | Iwatsuki et al. | |
| 2017/0269497 | A1 | 9/2017 | Murasawa et al. | |

FOREIGN PATENT DOCUMENTS

| | | |
|---|---|---|
| JP | 57-168255 | 10/1982 |
| JP | 58-108548 | 6/1983 |
| JP | 58-108549 | 6/1983 |
| JP | 58-117555 | 7/1983 |
| JP | 59-166968 | 9/1984 |
| JP | 2-079862 | 3/1990 |
| JP | 5-273789 | 10/1993 |
| JP | 6-202381 | 7/1994 |
| JP | 8-006307 | 1/1996 |
| JP | 8-305090 | 11/1996 |
| JP | 10-339973 | 12/1998 |
| JP | 11-184167 | 7/1999 |
| JP | 11-202560 | 7/1999 |
| JP | 2000-098666 | 4/2000 |
| JP | 2000-105490 | 4/2000 |
| JP | 2001-117287 | 4/2001 |
| JP | 2006-039357 | 2/2006 |
| JP | 2009-069500 | 4/2009 |
| JP | 2010-117519 | 5/2010 |
| JP | 2010-169840 | 8/2010 |
| JP | 2012-048167 | 3/2012 |
| JP | 2012-063438 | 3/2012 |
| JP | 2012-078790 | 4/2012 |
| JP | 2012-083389 | 4/2012 |
| JP | 2013-057817 | 3/2013 |
| JP | 2013-064856 | 4/2013 |
| JP | 2017-003858 | 1/2017 |

* cited by examiner

CARRIER, DEVELOPER, SUPPLEMENTAL DEVELOPER, IMAGE FORMING APPARATUS, IMAGE FORMING METHOD, AND PROCESS CARTRIDGE

CROSS-REFERENCE TO RELATED APPLICATIONS

This patent application is based on and claims priority pursuant to 35 U.S.C. § 119(a) to Japanese Patent Application No. 2017-052864, filed on Mar. 17, 2017, in the Japan Patent Office, the entire disclosure of which is hereby incorporated by reference herein.

BACKGROUND

Technical Field

The present invention relates to a carrier, a developer, a supplemental developer, an image forming apparatus, an image forming method, and a process cartridge.

Description of the Related Art

In electrophotographic image formation, an electrostatic latent image is formed on an electrostatic latent image bearer such as a photoconductive material, and a developer including a toner is used to develop the electrostatic latent image into a toner image. The toner image is then transferred onto and fixed on a recording medium to thereby provide an output image. In the field of electrophotography, monochrome copiers and printers have been rapidly replaced with full-color copiers and printers in recent years. Thus, the market of full-color copiers and printers has been expanding.

On the other hand, with respect to developer, two-component developer including a carrier and a toner is conventionally known. While two-component developer can form a high-quality image at an early stage of its use, use of this developer may result in problems, such as deterioration of image quality and occurrence of color smear, in accordance with the number of copies increasing.

Studies have been conducted to improve the durability of a carrier used for such a two-component developer by coating of the carrier with an appropriate resin material for the following purposes: prevention of toner spent on the surface of the carrier, formation of a uniform carrier surface, prevention of surface oxidation, prevention of a reduction in moisture sensitivity, prolongation of the service life of the developer, protection of a photoconductor from wear or scratching caused by the carrier, control of charging polarity, and adjustment of the amount of charging.

In attempting to prevent the coating layer (i.e., resin coating) from scraping caused by wear of the carrier surface, one proposed technique involves introducing fine metal particles having high resistance to scraping into the resin layer.

Another proposed technique involves introducing two different types of fine particles in the coating layer formed on the core.

SUMMARY

According to one aspect of the invention, a carrier includes a core particle and a resin layer coating a surface of the core particle, the resin layer including fine metal particles. A detected metal element amount A obtained by X-ray photoelectron spectrometry of the surface of the carrier is in a range of 4.0 atomic %≤A≤20.0 atomic % and an average major-axis length B of the fine metal particles exposing from the resin layer is in a range of 100 nm≤B≤800 nm.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
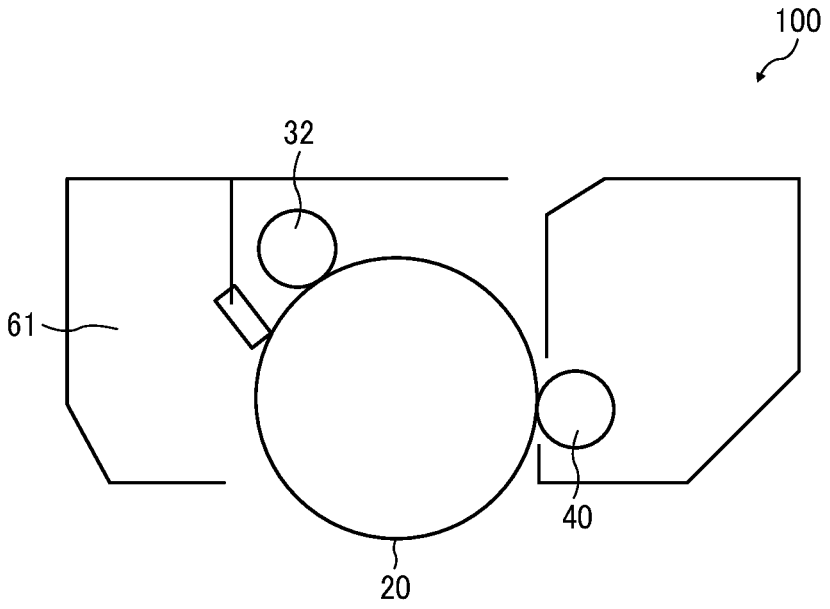
FIG. 1 is a schematic view of a process cartridge according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

At present, a carrier used for a two-component developer is required to achieve improvements in image quality and durability, enable stable supply of a developer to a developing region, have an excellent ability to prevent toner spent, and enable continuous paper feeding with a printing density of low image area percentage even in a high-speed machine using a low-temperature fixing toner. Unfortunately, conventional carriers do not satisfactorily exhibit the aforementioned properties at levels required in the current market.

The present invention is embodied according to an object to provide a carrier which achieves improvements in image quality and durability, which enables reliable supply of a developer to a developing region, which has an excellent ability to prevent toner spent, and which enables continuous paper feeding with a printing density of low image area percentage even in a high-speed machine using a low-temperature fixing toner.

Embodiments of the present invention will next be described in detail.

The carrier according to an embodiment of the present invention includes a core particle, and a resin layer coating a surface of the core particle, where the resin layer including fine metal particles. A detected metal element amount A obtained by X-ray photoelectron spectrometry of the surface of the carrier is in a range of 4.0 atomic %≤A≤20.0 atomic % and an average major-axis length B of the fine metal particles exposing from the resin layer is in a range of 100 nm≤B≤800 nm.

A detected metal element amount A equal to or greater than 4.0 atomic % leads to a reduction in wear of the resin layer, prevention of a reduction in resistance of the carrier, and prevention of carrier adhesion.

If the fine metal particles comprise an inorganic material, this readily results in a relatively small area of an organic material (binder resin) on the carrier surface, and thus chemical or physical spent is reduced even though an organic material (toner) externally contacts with the carrier. A reason for the reduction of the chemical spent is estimated as follows. Since the binder resin accounts for a small area of the carrier surface and thus the number of functional groups derived from the resin is small on the carrier surface, the interaction between the toner surface and the functional groups is reduced, and this leads to prevention of spent. A reason for the reduction of the physical spent is estimated as follows. Although the binder resin of the carrier surface and the toner resin are generally soft so that these resins are likely to adhere to each other through contact, a detected metal element amount A equal to or greater than 4.0 atomic % leads to a small opportunity for the contact between these resins, and this results in prevention of spent. It is noted that a detected metal element amount A equal to or less than 20.0 atomic % results in prevention of removal of the fine metal particles, so that the aforementioned technological effects can be attained reliably.

The detected metal element amount A more preferably is in of 4.0 atomic %≤A≤15.0 atomic %. The detected metal element amount A can be adjusted by adjustment of the amount of the metal element included in the resin layer, or adjustment of the drying time after carrier coating.

In the present disclosure, the detected metal element amount A is measured by X-ray photoelectron spectrometry (XPS). The detected metal element amount A can be measured with an apparatus AXIS/ULTRA (manufactured by Shimadzu/KRATOS). Abeam irradiation region is about 900 μm×600 μm, and a detection area is 25 carriers×17. Penetration depth is 0 to 10 nm, and the carrier surface is defined according to the penetration depth. Specifically, the detected metal element amount A is measured under the following conditions: measurement mode is Al: 1486.6 eV, excitation source is monochrome (Al), detection is spectrum mode, and magnet lens is OFF. Firstly, the elements to be detected are specified by wide scanning. Subsequently, the peak is detected by narrow scanning on the element basis. Thereafter, the detected metal element amount A (atomic %) can be calculated with the peak analysis software attached to the apparatus.

In the present disclosure, the average major-axis length B is in a range of 100 nm≤B≤800 nm. The average major-axis length B corresponds to the average of the major-axis lengths (i.e., lengths of the longest portions) of protrusions of the fine metal particles exposed through the resin layer. An average major-axis length B of the range of 100 nm≤B≤800 nm leads to a reduction in wear of the resin layer and prevention of toner spent. An average major-axis length B falling within this range also leads to an improvement in stability of the fine metal particles in the resin layer and prevention of removal of the fine metal particles. In the case where the average major-axis length B exceeds 800 nm, there is possibility that the core particle is exposed. Such a case is distinguished from the present invention. Even if the average major-axis length B is in the range of 100 nm≤B≤800 nm, a detected metal element amount A of more than 20.0 atomic % also provides the possibility of exposure of the core particle.

The average major-axis length B more preferably is in a range of 100 nm≤B≤600 nm. The average major-axis length B can be adjusted by adjustment of the amount of the fine metal particles included in the resin layer, or use of a material having low circularity.

In the present disclosure, the average major-axis length B is determined as follows. One hundred carriers randomly selected are photographed with a scanning electron microscope (Hitachi ultrahigh resolution field-emission scanning electron microscope SU8000 series) under the following conditions: applied voltage of 1.0 kV, emission current of from 8 to 13 mA, and magnification of 10,000, to visually select about five carriers which can be observed in one field of view, record the major-axis lengths which is the maximum of protrusions of the fine metal particles exposed from the resin layer of the carrier, and then repeat the above-described processing for 100 fields of view. The average major axis length is obtained as a calculated average of the recorded major-axis lengths.

For the carrier according to an embodiment of the present invention, the density of the fine metal particles in the resin layer is preferably adjusted so as to increase outward from the side of the core particle. The fine metal particles preferably have a density gradient from the interior of the carrier to the exterior thereof. Setting the density of the fine metal particles to be higher at the exterior of the carrier leads to an improvement in wear resistance of the resin layer over a long period of time, and prevention of toner spent. Setting the density of the fine metal particles to be lower in the interior of the carrier leads to improved adhesion between the core particle and the resin layer, resulting in prevention of removal of the resin layer from the core particle.

Such a density gradient in the resin layer can be achieved by a process in which a first coating layer is formed and a second coating layer is formed immediately after formation of the first coating layer, for example.

In the present disclosure, preferably, the fine metal particles comprise two or more different types of fine metal particles and 30 mass % or more of all the fine metal particles have a particle size D of a range of 400 nm≤D≤1,000 nm. According to those fine metal particles satisfying this condition, it can be attained that the surface of the carrier is not contaminated with toner components, and can be prevented from scraping and toner spent over a long period of time. Fine metal particles having a particle size D of more than 1,000 nm are likely to be removed from the resin layer, and may result in low resistance and occurrence of carrier adhesion due to exposure of the core particle, so that carrier adhesion may happen. Fine metal particles having a particle size D of less than 400 nm are likely to be covered with a toner spent, and the surfaces of the fine metal particles may be prevented from being exposed for a long period of time. The fine metal particles comprising two or more different types of fine metal particles results in formation of protrusions at irregular pitches. The degree of spent of toner components varies depending on the pitches of the protrusions; hence, a long period of time is required for toner spent on the entire surface of the carrier. Therefore, the carrier exhibits high resistance to toner spent. The particle size D more preferably falls within a range of 450 nm to 800 nm.

The fine metal particles used in the present disclosure may include a semiconductor material. No particular limitation is imposed on the type of the material for the fine metal particles, and the material preferably has a long-term stable structure. Examples of the material include compounds, such as alumina, titanium oxide, barium sulfate, tungsten-doped tin oxide, lithium ferrite, magnesium hydroxide, MnZn ferrite, and phosphorus-doped tin oxide. The resin layer may include particles other than the fine metal particles.

In the present disclosure, no particular limitation is provided on the resin used for the resin layer. The resin is preferably a copolymer resin prepared through thermal treatment of an acrylic copolymer including a unit A represented by the following formula 1 and a unit B represented by the following formula 2 and formed by radical copolymerization between monomer components A and B respectively represented by the formulae 1 and 2.

Unit A:

Formula 1

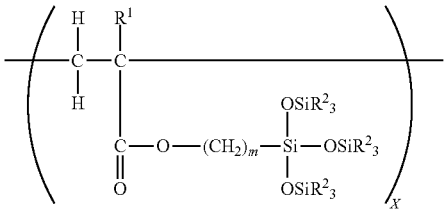

In the formula 1, $R^1$ denotes a hydrogen atom or a methyl group; m denotes an integer of 1 to 8; $R^2$ denotes an alkyl group having one to four carbon atoms; and X is from 10 to 90 mol %, preferably from 10 to 40 mol %, more preferably from 20 to 30 mol %.

The unit A (monomer component A) has, on its side chain, an atomic group having many methyl groups (tris(trimethylsiloxy)silane). A high percentage of the unit A (monomer component A) relative to the entire copolymer resin results in low surface energy, so that adhesion of a toner resin component or a wax component is reduced. The unit A (monomer component A) of less than 10 mol % may not achieve its technological effects sufficiently, so that adhesion of a toner component is enhanced. The unit A (monomer component A) of more than 90 mol % results in a decrease in amount of the unit B (monomer component B), so that sufficient toughness is not attained and adhesion between the core particle and the resin layer is deteriorated, resulting in possibility of impaired durability of the resin layer.

$R^2$ denotes an alkyl group having one to four carbon atoms. As an example of the monomer component A for forming the unit A which includes the $R^2$, there may be tris(trialkylsiloxy)silane compounds represented by the following formulae where Me denotes a methyl group, Et denotes an ethyl group, and Pr denotes a propyl group:

$CH_2{=}CMe\text{-}COO{-}C_3H_6{-}Si(OSiMe_3)_3$;
$CH_2{=}CH{-}COO{-}C_3H_6{-}Si(OSiMe_3)_3$;
$CH_2{=}CMe\text{-}COO{-}C_4H_8{-}Si(OSiMe_3)_3$;
$CH_2{=}CMe\text{-}COO{-}C_3H_6{-}Si(OSiEt_3)_3$;
$CH_2{=}CH{-}COO{-}C_3H_6{-}Si(OSiEt_3)_3$;
$CH_2{=}CMe\text{-}COO{-}C_4H_8{-}Si(OSiEt_3)_3$;
$CH_2{=}CMe\text{-}COO{-}C_3H_6{-}Si(OSiPr_3)_3$;
$CH_2{=}CH{-}COO{-}C_3H_6{-}Si(OSiPr_3)_3$; and
$CH_2{=}CMe\text{-}COO{-}C_4H_8{-}Si(OSiPr_3)_3$.

No particular limitation is provided on the method for producing the monomer component A for the unit A. Thus, the monomer component A can be produced by a method including reaction between tris(trialkylsiloxy)silane and allyl acrylate or allyl methacrylate in the presence of a platinum catalyst, or a method including reaction between methacryloxyalkyltrialkoxysilane and hexaalkyldisiloxane in the presence of a carboxylic acid and an acid catalyst (disclosed in Japanese Unexamined Patent Application Publication No. 11-217389), for example.

The unit B is a crosslinking component and is represented by the following formula 2.

Unit B:

Formula 2

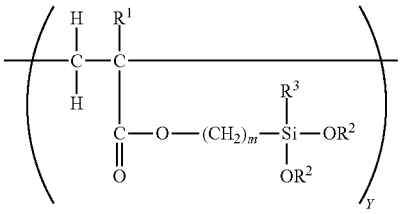

In the formula 2, $R^1$ denotes a hydrogen atom or a methyl group; m denotes an integer of from 1 to 8; $R^2$ denotes an alkyl group having one to four carbon atoms; and $R^3$ denotes an alkyl group having one to eight carbon atoms (e.g., a methyl group, an ethyl group, a propyl group, or a butyl group) or an alkoxy group having one to four carbon atoms (e.g., a methoxy group, an ethoxy group, a propoxy group, or a butoxy group). The monomer component B (including a precursor thereof) for the unit B is a radically polymerizable bifunctional (if $R^3$ is an alkyl group) or trifunctional (if $R^3$ is an alkoxy group) silane compound. Y is preferably from 10 to 90 mol %, more preferably from 10 to 80 mol %, particularly preferably from 15 to 70 mol %. The unit B of less than 10 mol % cannot achieve sufficient toughness. The unit B of more than 90 mol % may results in formation of a hard and brittle coating layer, so that the coating layer is easy removed and environmental characteristics are deteriorated. This is probably attributed to the fact that a large amount of the hydrolyzed crosslinking component remains in the form of a silanol group, so that the environmental characteristics (humidity dependence) are deteriorated.

Examples of the monomer component B include 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane, and 3-acryloxypropyltri(isopropoxy)silane.

Japanese Patent No. 3691115 (corresponding to JP-08-305090-A) discloses a technique for enhancing the durability of a coating layer by crosslinking. Japanese Patent No. 3691115 (corresponding to JP-08-305090-A) discloses an electrostatic image developing carrier including a magnetic particle coated with a thermosetting resin prepared through crosslinking of a copolymer with an isocyanate compound, the copolymer being composed of an organopolysiloxane having a vinyl group at least at its end and a radically copolymerizable monomer having at least one functional group selected from the group consisting of a hydroxyl group, an amino group, an amide group, and an imide group. Unfortunately, the carrier fails to achieve sufficient durability due to removal or scraping of the coating layer.

The reason for this, which has not been fully elucidated, is estimated as follows. In the case of a thermosetting resin prepared through crosslinking of the aforementioned copolymer with an isocyanate compound, as is clear from the structural formula of the copolymer, the copolymer includes a small number (per unit weight of the copolymer) of functional groups (active-hydrogen-including groups, such as amino groups, hydroxy groups, carboxyl groups, or mercapto groups) capable of reacting (crosslinking) with the isocyanate compound, and thus a dense two- or three-dimensional crosslink structure cannot be formed at crosslinking points. Consequently, the carrier fails to achieve sufficient durability since in long-term use of the carrier, removal or scraping of the coating layer easily occurs due to small wear resistance of the coating layer. Occurrence of the removal or scraping of the coating layer results in a variation in image quality and carrier adhesion due to a reduction in resistance of the carrier. The removal or scraping of the coating layer also results in poor fluidity of a developer and a reduction in amount of supply of the developer, this causing lowered image density, background smear (due to TC up), and toner scattering.

The copolymer resin suitable for use in the present disclosure includes a large number (per unit weight of the resin) of bifunctional or trifunctional crosslinkable functional groups (points); i.e., the number (per unit weight) is two to three times that of the functional groups in the aforementioned conventional copolymer. Since the copolymer resin is further subjected to polycondensation and crosslinking, the resultant coating layer probably has very high toughness and scraping resistance and achieves high durability.

The coating layer maintains stability over time, probably because the crosslinking by a siloxane bond achieves high binding energy and high stability to thermal stress, as compared with the crosslinking by an isocyanate compound.

In the present disclosure, the copolymer resin may further include a unit C represented by the following formula 3 so as to impart sufficient flexibility to the resin layer, and to achieve good adhesion between the core particle and the resin layer and between the resin layer and the fine metal particles.

Unit C (or Monomer Component C): (Acrylic Component)

Formula 3

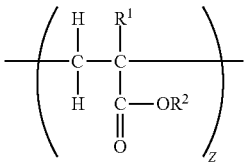

In the formula 3, $R^1$ denotes a hydrogen atom or a methyl group, and $R^2$ denotes an aliphatic hydrocarbon group having one to four carbon atoms, such as a methyl group, an ethyl group, a propyl group, or a butyl group.

In the case where the unit C is included, the unit A content X is from 10 to 40 mol %, the unit B content Y is from 10 to 40 mol %, and the unit C content Z is from 30 to 80 mol %, preferably from 35 to 75 mol %. Preferably, the relation: 60 mol %<Y+Z<90 mol % is satisfied. More preferably, the relation: 70 mol %<Y+Z<85 mol % is satisfied. In the case where the amount of the unit C (monomer component C) exceeds 80 mol %, either the content X or the content Y is 10 mol % or less. This case encounters difficulty in achieving the water repellency, hardness, and flexibility (reduced scraping) of the carrier coating layer.

The acrylic compound (monomer) of the monomer component C for the unit C is preferably an acrylic acid ester or a methacrylic acid ester. Specific examples thereof include methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino)ethyl methacrylate, and 2-(diethylamino)ethyl acrylate. Among these compounds, alkyl methacrylate is preferred, and methyl methacrylate is particularly preferred. These compounds may be used singly or in combination of two or more species.

The aforementioned copolymer resin is an acrylic copolymer prepared through radical copolymerization of monomers including the monomer component A and the monomer component B, and includes a large number of crosslinkable functional groups per unit weight of the resin. In addition, the monomer component B (crosslinking component) is subjected to polycondensation and crosslinking by thermal treatment. Therefore, the resultant resin layer probably has very high toughness and scraping resistance and achieves high durability.

The resin layer maintains stability over time, probably because the crosslinking by a siloxane bond achieves high binding energy and high stability to thermal stress, as compared with the crosslinking by an isocyanate compound.

An exemplary copolymer resin including the aforementioned unit A, unit B, and unit C is illustrated below. The reference symbols in the following formula have the same meanings as described above.

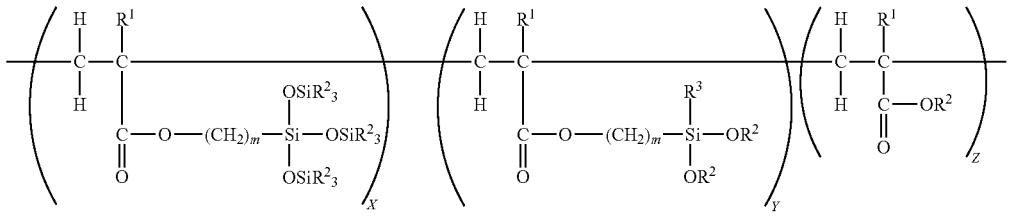

Unit A Unit B Unit C

The aforementioned copolymer resin should have a molecular weight falling within a preferred range, from the viewpoint of prevention of inhomogeneity of the resin layer. For example, the copolymer resin has a weight average molecular weight of preferably from 5,000 to 100,000, more preferably from 10,000 to 70,000, still more preferably from 30,000 to 40,000. A weight average molecular weight of less than 5,000 leads to insufficient strength of the resin layer, whereas a weight average molecular weight of more than 100,000 results in an increase in liquid viscosity, so that productivity of the carrier is deteriorated.

In the present disclosure, the composition used for formation of the resin layer (hereinafter may be referred to as the "resin layer composition") preferably includes a silicone resin having a silanol group and/or a functional group capable of generating a silanol group through hydrolysis. The silicone resin having a silanol group and/or a functional group capable of generating a silanol group through hydrolysis (e.g., a negative group such as a halogeno group bonded to an Si atom or an alkoxy group) can be polycondensed directly with the crosslinking component B of the copolymer, or with the crosslinking component B in the form of a silanol group. Incorporation of the silicone resin component into the copolymer leads to a further improvement in toner spent resistance.

In the present disclosure, the silicone resin preferably includes at least one of the repeating units represented by the following formula (I).

(I)

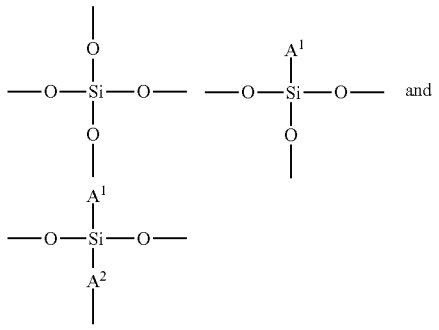

In the formula (I), $A^1$ denotes a hydrogen atom, a halogen atom, a hydroxy group, a methoxy group, a lower alkyl group having one to four carbon atoms, or an aryl group (e.g., a phenyl group or a tolyl group), and $A^2$ denotes an alkylene group having one to four carbon atoms or an arylene group (e.g., a phenylene group).

The aryl group preferably has 6 to 20 carbon atoms, more preferably 6 to 14 carbon atoms. Examples of the aryl group include aryl groups derived from benzene, such as a phenyl group; aryl groups derived from condensed polycyclic aromatic hydrocarbons, such as naphthalene, phenanthrene, and anthracene; and aryl groups derived from chain polycyclic aromatic hydrocarbons, such as biphenyl and terphenyl. The aryl group may be substituted by any substituent.

The arylene group preferably has 6 to 20 carbon atoms, more preferably 6 to 14 carbon atoms. Examples of the arylene group include arylene groups derived from benzene, such as a phenylene group; arylene groups derived from condensed polycyclic aromatic hydrocarbons, such as naphthalene, phenanthrene, and anthracene; and arylene groups derived from chain polycyclic aromatic hydrocarbons, such as biphenyl and terphenyl. The arylene group may be substituted by any substituent.

No particular limitation is provided on the commercially available silicone resin usable in the present disclosure. Thus, the commercially available silicone resin may include KR251, KR271, KR272, KR282, KR252, KR255, KR152, KR155, KR211, KR216, and KR213 (manufactured by Shin-Etsu Silicones); and AY42-170, SR2510, SR2400, SR2406, SR2410, SR2405, and SR2411 (manufactured by Dow Corning Toray Silicone Co., Ltd.) (manufactured by Dow Corning Toray Co., Ltd), for example.

A variety of silicone resins can be used as described above. Among these silicone resins, methyl silicone resin is particularly preferred from the viewpoint of toner spent resistance and reduced environment-dependent variation in charging amount.

The silicone resin has a weight average molecular weight of from 1,000 to 100,000, preferably about from 1,000 to 30,000. The use of the silicone resin having a molecular weight of more than 100,000 may lead to an excessive increase in the viscosity of a coating liquid during application thereof, resulting in unsatisfactory homogeneity of a coating layer or an insufficient increase in the density of the resin layer after curing. The use of the silicone resin having a molecular weight of less than 1,000 may cause problems, such as formation of a brittle resin layer through curing.

The content of the silicone resin is from 5 mass % to 95 mass %, preferably 10 mass % to 60 mass %, relative to the aforementioned copolymer. A content of less than 5 mass % may lead to an insufficient improvement in toner spent resistance, whereas a content of more than 95 mass % may lead to insufficient toughness of the resin layer, resulting in scraping of the layer.

In the present disclosure, the resin layer composition may include an additional resin other than the silicone resin, and no particular limitation is imposed on the additional resin. Examples of the additional resin include acrylic resins, amino resins, polyvinyl resins, polystyrene resins, halogenated olefin resins, polyester, polycarbonate, polyethylene, polyvinyl fluoride, polyvinylidene fluoride, polytrifluoroethylene, polyhexafluoropropylene, copolymers of vinylidene fluoride and vinyl fluoride, fluoroterpolymers (e.g., terpolymers of tetrafluoroethylene, vinylidene fluoride, and a non-fluorinated monomer), and silicone resins not having a silanol group or a hydrolyzable functional group. These resins may be used in combination of two or more species. Particularly preferred is an acrylic resin, in view of strong adhesion to the core particle and the fine metal particles and low brittleness.

The acrylic resin preferably has a glass transition temperature of from 20 to 100° C., more preferably from 25 to 80° C. Such an acrylic resin, which has appropriate elasticity, can absorb a strong impact on the resin layer caused by the friction between a toner and a carrier or between carriers during triboelectric charging of a developer, thereby preventing impairment of the resin layer and the fine metal particles.

The resin layer composition preferably further contains a crosslinked product of an acrylic resin and an amino resin. The crosslinked product can prevent fusion between resin layers while maintaining appropriate elasticity. No particular limitation is provided on the amino resin. The amino resin is preferably a melamine resin or a benzoguanamine resin, which can improve the charge-imparting ability of the carrier. If the charge-imparting ability of the carrier is required to be appropriately controlled, the melamine resin and/or the benzoguanamine resin may be used in combination with another amino resin.

The acrylic resin capable of crosslinking with the amino resin is preferably an acrylic resin having a hydroxyl group and/or a carboxyl group, more preferably an acrylic resin having a hydroxyl group. The use of such an acrylic resin can improve adhesion with the core particle or the fine metal particles, and also the dispersion stability of the fine metal particles. The acrylic resin preferably has a hydroxyl value of 10 mgKOH/g or more, more preferably 20 mgKOH/g or more.

The resin layer composition may contain an aminosilane coupling agent. Examples of the aminosilane coupling agent include, but are not particularly limited to, r-(2-aminoethyl) aminopropyltrimethoxysilane, r-(2-aminoethyl)aminopropylmethyldimethoxysilane, N-β-(N-vinylbenzylaminoethyl)-r-aminopropyltrimethoxysilane hydrochloride, 3-aminopropylmethyldiethoxysilane, and 3-aminopropyltrimethoxysilane. These coupling agents may be used in combination of two or more species.

A titanium catalyst, a tin catalyst, a zirconium catalyst, or an aluminum catalyst can be used for promoting the condensation reaction of the unit B. Among these catalysts, a titanium catalyst exerts excellent effects. In particular, a titanium alkoxide or a titanium chelate is preferred.

A reason for this is considered as follows. Such a titanium catalyst effectively promotes the condensation reaction of silanol groups derived from the unit B, and is less likely to be inactivated. Examples of the titanium alkoxide catalyst include titanium diisopropoxybis(ethylacetoacetate) represented by the following formula 4. Examples of the titanium chelate catalyst include titanium diisopropoxybis(triethanolaminate) represented by the following formula 5.

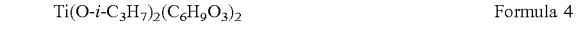

$$Ti(O\text{-}i\text{-}C_3H_7)_2(C_6H_9O_3)_2 \quad \text{Formula 4}$$

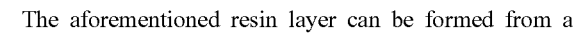

$$Ti(O\text{-}i\text{-}C_3H_7)_2(C_6H_{14}O_3N)_2 \quad \text{Formula 5}$$

The aforementioned resin layer can be formed from a resin layer composition including a copolymer including the unit A and unit B, and optionally a resin other than the copolymer including the unit A and unit B, the aforementioned catalyst, and a solvent. Specifically, the resin layer may be formed through condensation of silanol groups during or after coating of the core particle with the resin layer composition.

No particular limitation is imposed on the method for condensation of silanol groups during coating of the core particle with the resin layer composition. For example, the method includes coating of the core particle with the resin layer composition under application of heat or light. No particular limitation is imposed on the method for condensing silanol groups after coating of the core particle with the resin layer composition. For example, the method includes coating of the core particle with the resin layer composition, and subsequent heating of the composition-coated core particle.

In the present disclosure, the carrier preferably has a volume average particle size of 20 μm to 45 μm. A volume average particle size of the carrier of less than 20 μm may results in reduced magnetization per particle, so that carrier adhesion occurs. A volume average particle size of the carrier of more than 45 μm may result in an increase in impact force at collision between carriers, so that stress to protrusions on the carrier surface layer increases. Thus, the protrusions on the carrier surface layer may fail to have sufficient charging ability due to the embedment or scraping of the fine metal particles, and difficulty is encountered in maintaining the amount of charging of a developer at a constant level during toner spent.

The volume average particle size of the carrier can be determined with Microtrac particle size analyzer (SRA type, manufactured by Nikkiso Co., Ltd.) under the following settings: range is 0.7 μm to 125 μm, refractive index of dispersant (methanol) is 1.33, and refractive index of carrier and core is 2.42.

In the present disclosure, the resin layer preferably has an average thickness of from 0.30 to 0.90 μm. An average thickness of less than 0.30 μm may lead to easy breakage and scraping of the resin layer upon use. An average thickness of more than 0.90 μm may result in occurrence of carrier adhesion in an image because of non-magnetic property of the resin layer, and may result in insufficient resistance-controlling effect.

In the present invention, no particular limitation is provided on the material for the core particle, so long as the material is magnetic. Examples of the material include ferromagnetic metals, such as iron and cobalt; iron oxides, such as magnetite, hematite, and ferrite; various alloys and compounds; and resin particles prepared through dispersion of any of these magnetic materials in a resin. Among these materials, Mn ferrite, Mn—Mg ferrite, and Mn—Mg—Sr ferrite are preferred in view of environmental friendliness.

The developer according to an embodiment of the present invention includes the carrier according to an embodiment of the present invention and a toner.

The toner includes a binder resin and a colorant, and may be either a monochrome toner or a color toner. The toner may include a release agent in order to apply the toner to an oilless system including a fixing roller that is not coated with a toner adhesion preventing oil. Such a toner generally causes filming; however, the carrier according to an embodiment of the present invention can maintain a charging site even in the case of occurrence of filming. Thus, the developer according to an embodiment of the present invention can maintain high quality over a long period of time.

The toner can be produced by any known method, such as a pulverization method or a polymerization method. For example, the production of the toner by the pulverization method includes kneading of toner materials to prepare a melt-kneaded product; cooling of the melt-kneaded product and subsequent pulverization and classification to prepare base particles; and addition of an external additive to the base particles for further improvements in transferability and durability.

Examples of the apparatus for kneading the toner materials include, but are not particularly limited to, a batch-type two-roll mill; a Banbury mixer; continuous twin-screw extruders, such as KTK-type twin-screw extruder (manufactured by Kobe Steel, Ltd.), TEM-type twin-screw extruder (manufactured by Toshiba Machine Co., Ltd.), twin-screw extruder (manufactured by KCK Co., Ltd.), PCM-type twin-screw extruder (manufactured by Ikegai Corp.), and KEX-type twin-screw extruder (manufactured by Kurimoto, Ltd.); and continuous single-screw kneaders, such as Co-Kneader (manufactured by Buss Corporation).

The cooled melt-kneaded product can be pulverized into coarse particles with a hammer mill or Roatplex, and then further pulverized into fine particles by a pulverizer utilizing jet stream or a mechanical pulverizer. The cooled melt-kneaded product is preferably pulverized so as to have an average particle size of from 3 to 15 μm.

The pulverized melt-kneaded product can be classified with a wind-power classifier. The pulverized melt-kneaded product is preferably classified so that the resultant base particles have an average particle size of from 5 to 20 μm.

In the case of addition of the external additive to the base particles, they are mixed together and agitated by a mixer so that the external additive adheres to the surfaces of the base particles while being pulverized.

Examples of the binder resin include, but are not particularly limited to, homopolymers of styrene and substituted styrene, such as polystyrene, poly-p-styrene, and polyvinyl-toluene; styrenic copolymers, such as styrene-p-chlorostyrene copolymers, styrene-propylene copolymers, styrene-vinyltoluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-methyl-α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, and styrene-maleic acid ester copolymers; polymethyl methacrylate; polybutyl methacrylate; polyvinyl chloride; polyvinyl acetate; polyethylene; polyester; polyurethane; epoxy resins; polyvinyl butyral; polyacrylic acid; rosins; modified rosins; terpene resins; phenolic resins; aliphatic and aromatic hydrocarbon resins; and aromatic petroleum resins. These resins may be used in combination of two or more species.

Examples of the binder resin for pressure fixing include, but are not particularly limited to, polyolefins, such as low-molecular-weight polyethylene and low-molecular-weight polypropylene; olefinic copolymers, such as ethylene-acrylic acid copolymers, ethylene-acrylic acid ester copolymers, styrene-methacrylic acid copolymers, ethylene-methacrylic acid ester copolymers, ethylene-vinyl chloride copolymers, ethylene-vinyl acetate copolymers, and ionomer resins; epoxy resins; polyester; styrene-butadiene copolymers; polyvinyl pyrrolidone; methyl vinyl ether-maleic anhydride copolymers, maleic-modified phenolic resins; and phenol-modified terpene resins. These resins may be used in combination of two or more species.

Examples of the colorant (pigment or dye) include, but are not particularly limited to, yellow pigments, such as Cadmium Yellow, Mineral Fast Yellow, Nickel Titanium Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake; orange pigments, such as Molybdenum Orange, Permanent Orange GTR, Pyrazolone Orange, Vulcan Orange, Indanthrene Brilliant Orange RK, Benzidine Orange G, and Indanthrene Brilliant Orange OK; red pigments, such as red iron oxide, Cadmium Red, Permanent Red 4R, Lithol Red, Pyrazolone Red, Watching Red Calcium Salt, Lake Red D, Brilliant Carmine 6B, Eosine Lake, Rhodamine Lake B, Alizarine Lake, and Brilliant Carmine 3B; purple pigments, such as Fast Violet B and Methyl Violet Lake; blue pigments, such as Cobalt Blue, Alkali Blue, Victoria Blue Lake, Phthalocyanine Blue, metal-free Phthalocyanine Blue, partially chlorinated Phthalocyanine Blue, Fast Sky Blue, and Indanthrene Blue BC; green pigments, such as Chrome Green, chromium oxide, Pigment Green B, and Malachite Green Lake; and black pigments, such as carbon black, oil furnace black, channel black, lamp black, acetylene black, azine dyes such as aniline black, azo dyes of metal salts, metal oxides, and composite metal oxides. These colorants may be used in combination of two or more species.

Examples of the release agent include, but are not particularly limited to, polyolefins (e.g., polyethylene and polypropylene), fatty acid metal salts, fatty acid esters, paraffin waxes, amide waxes, polyhydric alcohol waxes, silicone varnishes, carnauba waxes, and ester waxes. These release agents may be used in combination of two or more species.

The toner may further contain a charge controlling agent. Examples of the charge controlling agent include, but are not particularly limited to, nigrosine; azine dyes including an alkyl group having 2 to 16 carbon atoms (see Japanese Examined Patent Publication No. 42-1627); basic dyes, such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), and C.I. Basic Green 4 (C.I. 42000); lake pigments of these basic dyes; C.I. Solvent Black 8 (C.I. 26150); quaternary ammonium salts, such as benzoylmethylhexadecylammonium chloride and decyltrimethyl chloride; dialkyl (e.g. dibutyl or dioctyl) tin compounds; dialkyltin borate compounds; guanidine derivatives; polyamine resins, such as amino group-including vinyl polymers and amino group-including condensation polymers; metal complex salts of monoazo dyes described in Japanese Examined Patent Publication Nos. 41-20153, 43-27596, 44-6397, and 45-26478; metal (e.g. Zn, Al, Co, Cr, or Fe) complexes of salicylic acid, dialkylsalicylic acid, naphthoic acid, and dicarboxylic acid described in Japanese Examined Patent Publication Nos. 55-42752 and 59-7385; sulfonated copper phthalocyanine pigments; organic boron salts; fluorine-including quaternary ammonium salts; and calixarene compounds. These agents may be used in combination of two or more species. Metal salts of salicylic acid derivatives, which are in white color, are preferably used in a color toner other than a black toner.

Examples of the external additive include, but are not particularly limited to, particles of inorganic materials, such as silica, titanium oxide, alumina, silicon carbide, silicon nitride, and boron nitride; and resin particles, such as polystyrene particles and polymethyl methacrylate particles having an average particle size of from 0.05 to 1 μm prepared through soap-free emulsion polymerization. These external additives may be used in combination of two or more species. Particularly preferred are surface-hydrophobized metal oxide (e.g., silica or titanium oxide) particles. A toner exhibiting excellent humidity-independent charging stability can be produced by using hydrophobized silica in combination with hydrophobized titanium oxide so that the amount of the hydrophobized titanium oxide is greater than that of the hydrophobized silica.

The carrier according to an embodiment of the present invention can be mixed with a toner to prepare a supplemental developer. Stable image quality can be achieved over a very long period of time by supplying the supplemental developer to an image forming apparatus wherein an image is formed while an excess of developer is discharged from the developing unit. Specifically, the degraded carrier within the developing unit can be replaced with a fresh carrier included in the supplemental developer, so that the amount of charging is maintained at a constant level over a long period of time for achievement of stable image quality. The supplemental developer preferably contains the toner in an amount of from 2 to 50 parts by mass relative to 1 part by mass of the carrier. An amount of the toner of less than 2 parts by mass leads to an excessive increase in supply of the carrier and thus very high carrier concentration in the developing unit, resulting in increased amount of charging of the developer. The increased amount of charging of the developer causes poor developing performance and low image density. An amount of the toner of more than 50 parts by mass leads to a decrease in the amount of the carrier included in the supplemental developer, resulting in reduced frequency of replacement of the degraded carrier with fresh carrier in the image forming apparatus. In such a case, the supplemental developer may fail to exert an intended effect against carrier degradation.

The image forming apparatus according to an embodiment of the present invention includes an electrostatic latent image bearer; a charging unit configured to charge the electrostatic latent image bearer; an exposure unit configured to form an electrostatic latent image on the electrostatic latent image bearer; a developing unit containing the developer according to an embodiment of the present invention, configured to develop the electrostatic latent image with the developer to thereby form a toner image; a transfer unit configured to transfer the toner image onto a recording medium; and a fixing unit configured to fix the transferred toner image on the recording medium. If necessary, the image forming apparatus further includes an appropriately selected unit, such as a charge eliminating unit, a cleaning unit, a recycling unit, or a controlling unit.

The image forming method according to an embodiment of the present invention includes forming an electrostatic latent image on an electrostatic latent image bearer; developing the electrostatic latent image with the developer according to an embodiment of the present invention to thereby form a toner image; transferring the toner image onto a recording medium; and fixing the transferred toner image on the recording medium.

The process cartridge according to an embodiment of the present invention includes an electrostatic latent image bearer; a charging unit configured to charge the surface of the electrostatic latent image bearer; a developing unit containing the developer according to an embodiment of the present invention, configured to develop an electrostatic latent image formed on the electrostatic latent image bearer with the developer; and a cleaning unit configured to clean the electrostatic latent image bearer.

FIG. 1 illustrates an exemplary process cartridge according to an embodiment of the present invention. The process cartridge (100) includes a photoconductor (20) serving as an electrostatic latent image bearer; a charging unit (32) configured to charge the photoconductor (20); a developing unit (40) containing the developer according to an embodiment of the present invention, configured to develop, with the developer, an electrostatic latent image formed on the photoconductor (20) to thereby form a toner image; and a cleaning unit (61) configured to remove the toner remaining on the photoconductor (20) after the toner image formed on the photoconductor (20) is transferred onto a recording medium, wherein the photoconductor (20), the charging unit (32), the developing unit (40), and the cleaning unit (61) are integrally supported. The process cartridge is detachably attached to the main body of an image forming apparatus, such as a copier or a printer.

Now will be described an image forming method using an image forming apparatus including the process cartridge. The photoconductor (20) is rotated at a predetermined peripheral speed. The peripheral surface of the photoconductor (20) is uniformly charged to a predetermined positive or negative potential by the charging unit (32). The charged peripheral surface of the photoconductor (20) is irradiated with light emitted from an exposure unit (e.g., a slit exposure unit or a laser beam scanning exposure unit) to form an electrostatic latent image. The electrostatic latent image formed on the peripheral surface of the photoconductor (20) is developed by the developing unit (40) with the developer according to an embodiment of the present invention to form a toner image. The toner image formed on the peripheral surface of the photoconductor (20) is transferred onto a transfer paper sheet fed between the photoconductor (20) and a transfer unit from a paper feeding unit in synchronization with the rotation of the photoconductor (20). The transfer paper sheet onto which the toner image has been transferred is separated from the peripheral surface of the photoconductor (20) and introduced into a fixing unit where the toner image is fixed on the transfer paper. Thereafter, the transfer paper sheet is discharged as a copy from the image forming apparatus. The cleaning unit (61) removes the toner remaining on the peripheral surface of the photoconductor (20) from which the toner image has been transferred. The cleaned photoconductor (20) is charge-eliminated by a charge eliminating unit to be ready for the next image forming.

EXAMPLES

The present invention will next be described in more detail with reference to Examples and Comparative Examples, but the present invention should not be limited to the Examples. Hereinafter, the term "part(s)" refers to "part (s) by mass."

Production Examples of Core Particles

Production Example 1 of Core Particles $MnCO_3$ powder, $Mg(OH)_2$ powder, and $Fe_2O_3$ powder were weighed and mixed together to prepare a powder mixture. The powder mixture was calcined with a heating furnace in an air atmosphere at 900° C. for three hours. The resultant calcined product was cooled and then pulverized to thereby prepare powder having a particle size of about 7 μm. The powder was mixed with a 1 mass % dispersant and water to thereby prepare a slurry. The slurry was fed to a spray drier for granulation, to thereby yield a granular product having an average particle size of about 40 μm. The granular product was placed in a firing furnace and fired in a nitrogen atmosphere at 1,250° C. for five hours. The resultant fired product was crushed with a crushing machine and then sieved for particle size adjustment, to thereby produce core particles C1 composed of spherical ferrite particles having a volume average particle size of about 35 μm. The volume average particle size was determined with Microtrac particle size analyzer (model: HRA9320-X100, manufactured by Nikkiso Co., Ltd.) in water under the following settings: material refractive index of 2.42, solvent refractive index of 1.33, and concentration of about 0.06.

Synthetic Examples of Resin

Synthetic Example 1 of Resin

Toluene (300 g) was added to a flask equipped with an agitator and heated to 90° C. under a stream of nitrogen gas. Subsequently, a mixture of 3-methacryloxypropyltris(trimethylsiloxy)silane represented by $CH_2{=}CMe\text{-}COO{-}C_3H_6{-}Si(OSiMe_3)_3$ (where Me represents a methyl group) (84.4 g, 200 mmol: Silaplane TM-0701T, manufactured by Chisso Corporation), 3-methacryloxypropylmethyldiethoxysilane (39 g, 150 mmol), methyl methacrylate (65.0 g, 650 mmol), and 2,2'-azobis-2-methylbutyronitrile (0.58 g, 3 mmol) was added dropwise to the flask over one hour. After completion of the dropwise addition, a solution of 2,2'-azobis-2-methylbutyronitrile (0.06 g, 0.3 mmol) in toluene (15 g) was added to the flask (the total amount of 2,2'-azobis-2-methylbutyronitrile was 0.64 g; i.e., 3.3 mmol), followed by mixing for three hours at from 90 to 100° C. for radical copolymerization, to thereby produce a resin E. The resin E had a weight average molecular weight of 33,000. The resin E was then diluted with toluene so that the resultant resin E solution had a non-volatile content of 24 mass %. The resin E solution had a viscosity of 8.8 $mm^2/s$ and a specific gravity of 0.91.

The weight average molecular weight was determined in terms of standard polystyrene by gel permeation chromatography. The viscosity was measured at 25° C. according to JIS-K2283. For determination of the non-volatile content, a coating composition (1 g) was weighed on an aluminum dish and heated at 150° C. for one hour, and the weight of the composition was measured after the one-hour heating. The non-volatile content was calculated by use of the following formula:

Non-volatile content (%)=(weight before heating−weight after heating)×100/weight before heating.

Production Examples of Toner

[Toner 1]

—Synthesis of Polyester Resin A—

Bisphenol A-ethylene oxide (2 mol) adduct (65 parts), bisphenol A-propylene oxide (3 mol) adduct (86 parts), terephthalic acid (274 parts), and dibutyltin oxide (2 parts) were added to a reaction vessel equipped with a cooling tube, an agitator, and a nitrogen feeding tube, and reaction was allowed to proceed at ambient pressure and 230° C. for 15 hours. Subsequently, reaction was allowed to proceed under a reduced pressure of from 5 to 10 mmHg for six hours, to thereby synthesize a polyester resin A. The polyester resin A had a number average molecular weight (Mn) of 2,300, a weight average molecular weight (Mw) of 8,000, a glass transition temperature (Tg) of 58° C., an acid value of 25 mgKOH/g, and a hydroxyl value of 35 mgKOH/g.

—Synthesis of Prepolymer (Polymer Capable of Reacting with Active-Hydrogen-Group-Including Compound)—

Bisphenol A-ethylene oxide (2 mol) adduct (682 parts by mass), bisphenol A-propylene oxide (2 mol) adduct (81 parts by mass), terephthalic acid (283 parts by mass), trimellitic anhydride (22 parts by mass), and dibutyltin oxide (2 parts by mass) were added to a reaction vessel equipped with a cooling tube, an agitator, and a nitrogen feeding tube, and reaction was allowed to proceed at ambient pressure and 230° C. for eight hours. Subsequently, reaction was allowed to proceed under a reduced pressure of from 10 to 15 mmHg for five hours, to thereby synthesize an intermediate polyester. The intermediate polyester had a number average molecular weight (Mn) of 2,100, a weight average molecular weight (Mw) of 9,600, a glass transition temperature (Tg) of 55° C., an acid value of 0.5, and a hydroxyl value of 49.

Subsequently, the intermediate polyester (411 parts by mass), isophorone diisocyanate (89 parts by mass), and ethyl acetate (500 parts by mass) were added to a reaction vessel equipped with a cooling tube, an agitator, and a nitrogen feeding tube, and reaction was allowed to proceed at 100° C. for five hours, to thereby synthesize a prepolymer (polymer capable of reacting with the aforementioned active-hydrogen-including compound). The prepolymer had a free isocyanate content of 1.60 mass % and a solid content (after being left at 150° C. for 45 minutes) of 50 mass %.

—Synthesis of Ketimine (the Aforementioned Active-Hydrogen-Including Compound)—

Isophoronediamine (30 parts by mass) and methyl ethyl ketone (70 parts by mass) were added to a reaction vessel equipped with an agitation rod and a thermometer, and reaction was allowed to proceed at 50° C. for five hours, to thereby synthesize a ketimine compound (the aforementioned active-hydrogen-including compound). The ketimine compound (the aforementioned active-hydrogen-including compound) had an amine value of 423.

—Preparation of Masterbatch—

Water (1,000 parts), carbon black Printex 35 (DBP oil absorption amount: 42 mL/100 g, pH: 9.5, manufactured by Degussa) (540 parts), and the polyester resin A (1,200 parts) were mixed together with a Henschel mixer (manufactured by Mitsui Mining Co., Ltd.). Subsequently, the resultant mixture was kneaded with a twin-roll mill at 150° C. for 30 minutes, and then roll-cooled and pulverized with a pulverizer (manufactured by Hosokawa Micron Corporation), to prepare a masterbatch.

—Preparation of Aqueous Medium—

Ion-exchange water (306 parts), a 10 mass % suspension liquid of tricalcium phosphate (265 parts), and sodium dodecylbenzenesulfonate (1.0 part) were mixed with agitation for uniform dissolution, to thereby prepare an aqueous medium.

—Measurement of Critical Micelle Concentration—

The critical micelle concentration of a surfactant was measured as follows. A surface tensiometer Sigma (manufactured by KSV Instruments) was used for analysis with a program installed in the Sigma system. A surfactant was added dropwise (in 0.01 wt % increments) to the aqueous medium, agitated, and allowed to stand still, followed by measurement of surface tension. The resultant surface tension curve was used to determine a surfactant concentration at which the surface tension no longer decreases by dropwise addition of the surfactant. The surfactant concentration was defined as the critical micelle concentration. The critical micelle concentration of sodium dodecylbenzenesulfonate to the aqueous medium was measured with the surface tensiometer Sigma. The critical micelle concentration was 0.05 wt % relative to the weight of the aqueous medium.

—Preparation of Toner Material Liquid—

The polyester resin A (70 parts), the prepolymer (10 parts by mass), and ethyl acetate (100 parts) were placed in a beaker and agitated for dissolution. Paraffin wax (HNP-9, melting point: 75° C., manufactured by Nippon Seiro Co., Ltd.) serving as a release agent (5 parts), MEK-ST (manufactured by Nissan Chemical Industries, Ltd.) (2 parts), and the masterbatch (10 parts) were added to the beaker. The resultant mixture was passed through Ultraviso Mill (bead mill) (manufactured by Aimex Co., Ltd.) charged with 0.5 mm zirconia beads (80 vol %) three times at a flow rate of 1 kg/hour and a disk peripheral speed of 6 m/second. Thereafter, the ketimine (2.7 parts by mass) was added to and dissolved in the mixture, to thereby prepare a toner material liquid.

—Preparation of Emulsion or Dispersion Liquid—

The aforementioned aqueous medium phase (150 parts by mass) was placed in a container and agitated with a TK homomixer (manufactured by Tokushu Kika Kogyo Co., Ltd.) at 12,000 rpm. The toner material dissolution or dispersion liquid (100 parts by mass) was added to the aqueous medium phase and mixed for 10 minutes, to thereby prepare an emulsion or dispersion liquid (emulsified slurry).

—Removal of Organic Solvent—

The emulsified slurry (100 parts by mass) was added to a flask equipped with an agitator and a thermometer and agitated at a peripheral speed of 20 m/minute for 12 hours at 30° C. for removal of the solvent.

—Washing—

The aforementioned dispersion slurry (100 parts by mass) was subjected to filtration under reduced pressure. Thereafter, ion-exchange water (100 parts by mass) was added to the filtrate cake and mixed by a TK homomixer at 12,000 rpm for 10 minutes, followed by filtration. Ion-exchange water (300 parts by mass) was added to the resultant filtrate cake and mixed by the TK homomixer at 12,000 rpm for 10 minutes, followed by filtration. This operation was performed twice. A 10 mass % aqueous sodium hydroxide solution (20 parts by mass) was added to the resultant filtrate cake and mixed by the TK homomixer at 12,000 rpm for 30 minutes, followed by filtration under reduced pressure. Ion-exchange water (300 parts by mass) was added to the resultant filtrate cake and mixed by the TK homomixer at 12,000 rpm for 10 minutes, followed by filtration. This operation was performed twice. Thereafter, 10 mass % hydrochloric acid (20 parts by mass) was added to the resultant filtrate cake and mixed by the TK homomixer at 12,000 rpm for 10 minutes, followed by filtration.

—Adjustment of Amount of Surfactant—

Ion-exchange water (300 parts by mass) was added to the filtrate cake prepared through the aforementioned washing, and mixed by the TK homomixer at 12,000 rpm for 10 minutes. The electric conductivity of the resultant toner dispersion liquid was measured, and the surfactant concentration of the toner dispersion liquid was calculated by use of a preliminarily prepared calibration curve of surfactant concentration. On the basis of the calculated value, ion-exchange water was added so as to achieve a target surfactant concentration of 0.05 wt %, to thereby prepare a toner dispersion liquid.

—Surface Treatment Step—

The toner dispersion liquid having the aforementioned target surfactant concentration was mixed by the TK homomixer at 5,000 rpm under heating by a water bath at a temperature T1 of 55° C. for 10 hours. Thereafter, the toner dispersion liquid was cooled to 25° C. and subjected to filtration. Subsequently, ion-exchange water (300 parts by mass) was added to the resultant filtrate cake and mixed by the TK homomixer at 12,000 rpm for 10 minutes, followed by filtration.

—Drying—

Finally, the resultant filtrate cake was dried with an air circulation dryer at 45° C. for 48 hours, and sieved with a 75 μm-opening mesh, to thereby produce toner matrix particles 1.

—Treatment with External Additive—

Subsequently, the toner matrix particles 1 (100 parts by mass) were mixed with hydrophobic silica powder having an average particle size of 100 nm (3.0 parts by mass), titanium oxide powder having an average particle size of 20 nm (0.5 parts by mass), and hydrophobic fine silica powder having an average particle size of 15 nm (1.5 parts) by a Henschel mixer, to thereby produce [toner 1]. The [toner 1] had a volume average particle size of 5.2 μm.

[Toner 2]

[Preparation of Pulverized Toner]

Crystalline polyester resin (4 parts by mass)

Amorphous resin 1 (35 parts by mass)

Amorphous resin 2 (55 parts by mass)

Composite resin (10 parts by mass)

Colorant: carbon black (14 parts by mass)

Release agent: carnauba wax (melting point: 81° C.) (6 parts by mass)

Charge controlling agent: monoazo metal complex (2 parts by mass)

Chromium complex salt dye (Bontron S-34, manufactured by Orient Chemical Industries Co., Ltd.) (2 parts by mass)

The aforementioned toner raw materials were preliminarily mixed by a Henschel mixer (FM20B, manufactured by Mitsui Miike Machinery Co., Ltd.) and then melt-kneaded with a twin-screw kneader (PCM-30, manufactured by Ikegai Corp.) at from 100° C. to 130° C. The resultant kneaded product was rolled into a thickness of 2.8 mm with a roller, and then cooled to room temperature with a belt cooler. The cooled product was coarsely pulverized into a particle size of from 200 to 300 μm with a hammer mill. Subsequently, the coarse particles were finely pulverized with a supersonic jet pulverizer Labo Jet (manufactured by Nippon Pneumatic Mfg. Co., Ltd.). Thereafter, the fine particles were classified to achieve a weight average particle size of 5.6±0.2 μm with an airflow classifier (MDS-I, manufactured by Nippon Pneumatic Mfg. Co., Ltd.) under appropriate adjustment of louver opening size, to thereby prepare toner matrix particles. Subsequently, the toner matrix particles (100 parts by mass) were mixed with an additive (HDK-2000, manufactured by Clariant) (1.0 part by mass) under agitation by a Henschel mixer, to thereby produce a pulverized toner [toner 2].

The aforementioned crystalline polyester was prepared from a 1,5-pentanediol compound (alcohol component) and a fumaric acid compound (carboxylic acid component). Specifically, monomers of the alcohol and carboxylic acid components were subjected to esterification reaction at ambient pressure and from 170 to 260° C. in the absence of a catalyst, and then antimony trioxide (400 ppm relative to the entire carboxylic acid component) was added to the reaction system, followed by polycondensation at 250° C. while the glycol was discharged to the outside of the reaction system under vacuum (3 Torr), to thereby produce the crystalline polyester. The crosslinking reaction was performed until the agitation torque reached 10 kg-cm (100 ppm), and the reaction was terminated by release of the reduced pressure state in the reaction system. The crystalline polyester had a glass transition temperature (Tg) of 98° C. and a softening temperature T½ of 104° C.

Figure 2:
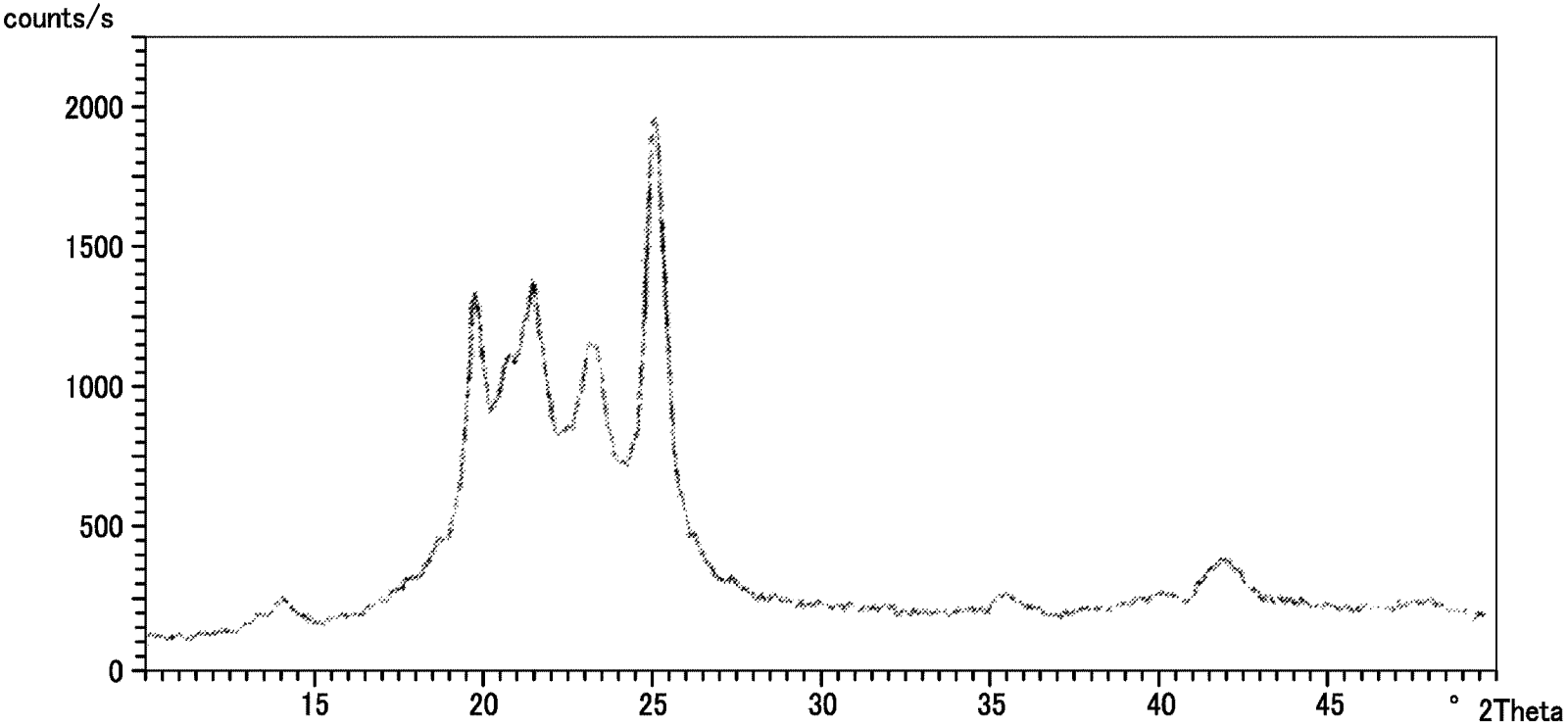
FIG. 2 is a graph presenting a result of X-ray diffraction analysis of a crystalline polyester resin used in embodiments of the invention.

The crystalline polyester exhibited at least one diffraction peak in an X-ray diffraction pattern at 2θ of from 19° to 25° as measured with a powder X-ray diffractometer; i.e., the polyester was found to have crystallinity. FIG. 2 illustrates the results of X-ray diffraction analysis of the crystalline polyester resin.

Each of the aforementioned amorphous resins 1 and 2 was prepared as follows.

The components illustrated in Table 1 or 2 were subjected to esterification reaction at ambient pressure and from 170 to 260° C. in the absence of a catalyst, and then antimony trioxide (400 ppm relative to the entire carboxylic acid component) was added to the reaction system, followed by polycondensation at 250° C. while the glycol was discharged to the outside of the reaction system under vacuum (3 Torr), to produce the resin. The crosslinking reaction was performed until the agitation torque reached 10 kg-cm (100 ppm), and the reaction was terminated by release of the reduced pressure state in the reaction system.

Each of the amorphous resins 1 and 2 exhibited no diffraction peak in an X-ray diffraction pattern; i.e., the resin was found to be amorphous.

TABLE 1

| Amorphous Resin 1 | | | | |
|---|---|---|---|---|
| Material | Softening temp. T½ [° C.] | Chloroform insoluble content [wt %] | Acid component | Alcohol component |
| Polyester | 140 | 21 | Fumaric acid<br>Trimellitic anhydride | Bisphenol A (2,2) propylene oxide<br>Bisphenol A (2,2) ethylene oxide |

TABLE 2

| Amorphous Resin 2 | | | | | | |
|---|---|---|---|---|---|---|
| | Softening temp. | Glass transition temp. | Molecular weight distribution | | | |
| Material | T½ [° C.] | Tg [° C.] | Main peak | Half width | Acid component | Alcohol component |
| Polyester | 89 | 62 | 4000 | 13000 | Terephthalic acid<br>Dodecylsuccinic anhydride<br>Trimellitic anhydride | Bisphenol A (2,2) propylene oxide<br>Bisphenol A (2,2) ethylene oxide |

The composite resin was prepared as follows.

Terephthalic acid (0.8 mol), fumaric acid (0.6 mol), trimellitic anhydride (0.8 mol), bisphenol A (2,2) propylene oxide (1.1 mol), and bisphenol A (2,2) ethylene oxide (0.5 mol), which are condensation-polymerizable monomers, and dibutyltin oxide (9.5 mol), serving as an esterification catalyst, were added to a 5 L four-neck flask equipped with a nitrogen feeding tube, a dehydration tube, an agitator, a dropping funnel, and a thermocouple, and then heated to 135° C. in a nitrogen atmosphere. Styrene (10.5 mol), acrylic acid (3 mol), and 2-ethylhexyl acrylate (1.5 mol), which are addition-polymerizable monomers, and t-butyl hydroperoxide (0.24 mol), serving as a polymerization initiator, were added to the dropping funnel, and the resultant mixture was added dropwise to the flask over five hours under agitation, to thereby allow reaction to proceed for six hours. Subsequently, the reaction mixture was heated to 210° C. over three hours, and reaction was allowed to proceed at 210° C. and 10 kPa so as to achieve a desired softening temperature. The thus-synthesized composite resin had a softening temperature of 115° C., a glass transition temperature of 58° C., and an acid value of 25 mgKOH/g.

Carrier production examples and developer preparation methods will be described below.

Carrier 1

<Resin Liquid 1-1>

Silicone resin solution [solid content: 41 mass % (SR2410, manufactured by Dow Corning Toray Silicone Co., Ltd.)] (143.0 parts by mass)

Resin E (14.0 parts by mass)

Titanium catalyst [solid content: 57 mass % (TC-754, manufactured by Matsumoto Fine Chemical Co., Ltd.)] (15.3 parts by mass)

Aminosilane [solid content: 100 mass % (SH6020, manufactured by Dow Corning Toray Silicone Co., Ltd.)] (1.3 parts by mass)

First fine particles illustrated in Table 3 (10.0 parts by mass)

Octane (830.0 parts by mass)

<Resin Liquid 1-2>

Silicone resin solution [solid content: 41 mass % (SR2410, manufactured by Dow Corning Toray Silicone Co., Ltd.)] (143.0 parts by mass)

Resin E (14.0 parts by mass)

Titanium catalyst [solid content: 57 mass % (TC-754, manufactured by Matsumoto Fine Chemical Co., Ltd.)] (15.3 parts by mass)

Aminosilane [solid content: 100 mass % (SH6020, manufactured by Dow Corning Toray Silicone Co., Ltd.)] (1.3 parts by mass)

Second fine particles illustrated in Table 3 (130 parts by mass)

Third fine particles illustrated in Table 3 (50 parts by mass)

Octane (830.0 parts by mass)

The aforementioned materials for each of the resin liquid 1-1 and the resin liquid 1-2 were dispersed with a homomixer for 10 minutes to thereby prepare a resin layer forming liquid. The resin liquid 1-1 was applied to the surfaces of the core particles C1 (5,000 parts by mass) with SPIRA COTA (manufactured by Okada Seiko Co., Ltd.) at 70° C. and 30 g/min so as to achieve a layer thickness of 0.25 μm. Subsequently, the resin liquid 1-2 was applied in the same manner as described above, followed by drying for eight minutes. The layer thickness was adjusted by controlling the amount of the liquid applied. The resultant carrier was fired in an electric furnace at 300° C. for one hour and then cooled. Thereafter, the fired product was pulverized with a 100 μm sieve to thereby produce a carrier 1.

The properties of the carrier 1 are illustrated in Table 3.

Carriers 2 to 10 and 13 to 26

Carriers 2 to 10 and 13 to 26 were produced in the same manner as the carrier 1, except that the types of first, second, and third fine particles, the amounts (parts by mass) of the fine particles, and the drying time were varied as illustrated in Table 3.

Carrier 11

<Resin Liquid 1>

Silicone resin solution [solid content: 41 mass % (SR2410, manufactured by Dow Corning Toray Silicone Co., Ltd.)] (286.0 parts by mass)

Resin E (28.0 parts by mass)

Titanium catalyst [solid content: 57 mass % (TC-754, manufactured by Matsumoto Fine Chemical Co., Ltd.)] (15.3 parts by mass)

Aminosilane [solid content: 100 mass % ($5H_{6020}$, manufactured by Dow Corning Toray Silicone Co., Ltd.)] (2.6 parts by mass)

Second fine particles illustrated in Table 3 (225.0 parts by mass)

Third fine particles illustrated in Table 3 (40 parts by mass)

Octane (1,660.0 parts by mass)

The materials for the resin liquid 1 were dispersed with a homomixer for 10 minutes to thereby prepare a resin layer forming liquid. The resin liquid 1 was applied to the surfaces of the core particles C1 with SPIRA COTA (manufactured by Okada Seiko Co., Ltd.) at 70° C. and 30 g/min so as to achieve a layer thickness of 0.50 μm, followed by drying for eight minutes. The resultant carrier was fired in an electric furnace at 300° C. for one hour and then cooled. Thereafter, the fired product was pulverized with a 100 μm sieve to thereby produce a carrier 11.

Carrier 12

A carrier 12 was produced in the same manner as the carrier 11, except that the amounts of the second and third fine particles and the drying time were varied as illustrated in Table 3.

Carrier 25

A carrier 25 was produced in the same manner as the carrier 1, except that the amount of the resin E was varied to 0 parts by mass and the amount of the silicone resin solution [solid content: 41 mass %] was varied to 314 parts by mass in the resin liquid 1-1 and the resin liquid 1-2.

Table 3 illustrates the details of developers 1 to 26 used for evaluation. Each of the developers 1 to 26 was prepared from the carrier (1 part by mass) and the toner (0.03 parts by mass). The detected metal element amount A and the average major-axis length B illustrated in Table 3 were determined by the methods described above. The density gradient (i.e., whether or not the density of the fine metal particles in the resin layer increases outward from the core particle side) can be determined through SEM observation of a cross section of the CP-processed coating layer of the carrier. The "fine resin particles" used in Examples 8 and 9 are Epostar S (trade name) manufactured by Nippon Shokubai Co., Ltd. "EC700" used in Example 10 is alumina/tin-doped indium oxide manufactured by Titan Kogyo, Ltd.

TABLE 3

| | | | | Resin layer constitution | | | | | |
|---|---|---|---|---|---|---|---|---|---|
| | | | | Inner layer First fine particles | | | Outer layer Second fine particles | | |
| | Carrier | Toner | Developer | Type | D50 nm | Amount (parts) | Type | D50 nm | Amount (parts) |
| Example 1 | Carrier1 | Toner1 | Developer1 | Ketjenblack | 40 | 10 | Barium sulfate | 600 | 130 |
| Example 2 | Carrier2 | Toner1 | Developer2 | Ketjenblack | 40 | 10 | Barium sulfate | 600 | 450 |
| Example 3 | Carrier3 | Toner1 | Developer3 | Ketjenblack | 40 | 10 | Barium sulfate | 600 | 450 |
| Example 4 | Carrier4 | Toner1 | Developer4 | Ketjenblack | 40 | 10 | Barium sulfate | 600 | 450 |
| Example 5 | Carrier5 | Toner1 | Developer5 | Ketjenblack | 40 | 10 | Barium sulfate | 600 | 450 |
| Example 6 | Carrier6 | Toner1 | Developer6 | Ketjenblack | 40 | 10 | Barium sulfate | 600 | 450 |
| Example 7 | Carrier7 | Toner1 | Developer7 | Ketjenblack | 40 | 10 | Barium sulfate | 600 | 450 |
| Example 8 | Carrier8 | Toner1 | Developer8 | Ketjenblack | 40 | 10 | Barium sulfate | 600 | 250 |
| Example 9 | Carrier9 | Toner1 | Developer9 | Ketjenblack | 40 | 10 | Barium sulfate | 600 | 450 |
| Example 10 | Carrier10 | Toner1 | Developer10 | — | | | EC700 | 400 | 250 |
| Example 11 | Carrier11 | Toner1 | Developer11 | | | | Barium sulfate | 600 | 225 |
| Example 12 | Carrier12 | Toner1 | Developer12 | Ketjenblack | 40 | 10 | Barium sulfate | 600 | 400 |
| Comparative Example 1 | Carrier13 | Toner1 | Developer13 | Ketjenblack | 40 | 10 | Barium sulfate | 600 | 50 |
| Example 13 | Carrier14 | Toner1 | Developer14 | Ketjenblack | 40 | 10 | Barium sulfate | 600 | 100 |
| Example 14 | Carrier15 | Toner1 | Developer15 | Ketjenblack | 40 | 10 | Barium sulfate | 800 | 200 |
| Example 15 | Carrier16 | Toner1 | Developer16 | Ketjenblack | 40 | 10 | Barium sulfate | 800 | 250 |
| Example 16 | Carrier17 | Toner1 | Developer17 | Ketjenblack | 40 | 10 | Barium sulfate | 900 | 250 |
| Comparative Example 2 | Carrier18 | Toner1 | Developer18 | Ketjenblack | 40 | 10 | Barium sulfate | 900 | 250 |
| Comparative Example 3 | Carrier19 | Toner1 | Developer19 | Ketjenblack | 40 | 10 | Alumina | 200 | 250 |
| Example 17 | Carrier20 | Toner1 | Developer20 | Ketjenblack | 40 | 10 | Alumina | 250 | 250 |
| Example 18 | Carrier21 | Toner1 | Developer21 | Ketjenblack | 40 | 10 | Barium sulfate | 700 | 250 |
| Example 19 | Carrier22 | Toner1 | Developer22 | Ketjenblack | 40 | 10 | Barium sulfate | 780 | 250 |
| Example 20 | Carrier23 | Toner1 | Developer23 | Ketjenblack | 40 | 10 | Barium sulfate | 930 | 250 |
| Comparative Example 4 | Carrier24 | Toner1 | Developer24 | Ketjenblack | 40 | 10 | Barium sulfate | 1000 | 250 |
| Example 21 | Carrier25 | Toner1 | Developer25 | Ketjenblack | 40 | 10 | Barium sulfate | 600 | 130 |
| Example 22 | Carrier1 | Toner2 | Developer26 | Ketjenblack | 40 | 10 | Barium sulfate | 600 | 130 |

TABLE 3-continued

| | Resin layer constitution Outer layer | | | | Whether or not fine particles having a volume average size D50 within a range of 400 nm to 1,000 nm account for 30% or more of all the fine metal particles. | |
|---|---|---|---|---|---|---|
| | Third fine particles | | | Drying | Parts corresponding to | |
| | Type | D50 nm | Amount (parts) | time min | 30% or more of all the fine metal particles | Determination |
| Example 1 | Oxygen-deficient tungsten-doped tin oxide | 600 | 50 | 8.0 | 54 | Yes |
| Example 2 | Lithium ferrite | 500 | 230 | 8.0 | 204 | Yes |
| Example 3 | Magnesium hydroxide | 800 | 240 | 15.0 | 207 | Yes |
| Example 4 | Titanium oxide | 650 | 300 | 15.0 | 225 | Yes |
| Example 5 | Mn ferrite | 700 | 400 | 30.0 | 255 | Yes |
| Example 6 | Phosphorus-doped tin oxide | 380 | 450 | 30.0 | 270 | Yes |
| Example 7 | Alumina | 380 | 450 | 30.0 | 270 | Yes |
| Example 8 | Fine resin particles | 500 | 217 | 7.0 | 140 | Yes |
| Example 9 | Fine resin particles | 500 | 217 | 8.0 | 200 | Yes |
| Example 10 | — | | | 8.0 | 75 | Yes |
| Example 11 | Ketjenblack | 40 | 10 | 8.0 | 68 | Yes |
| Example 12 | Ketjenblack | 40 | 10 | 10.0 | 123 | Yes |
| Comparative Example 1 | — | | | 1.0 | 15 | Yes |
| Example 13 | — | | | 1.0 | 30 | Yes |
| Example 14 | Oxygen-deficient tungsten-doped tin oxide | 800 | 200 | 17.0 | 120 | Yes |
| Example 15 | Oxygen-deficient tungsten-doped tin oxide | 800 | 250 | 23.0 | 150 | Yes |
| Example 16 | Oxygen-deficient tungsten-doped tin oxide | 800 | 250 | 32 | 150 | Yes |
| Comparative Example 2 | Oxygen-deficient tungsten-doped tin oxide | 800 | 250 | 42.0 | 150 | Yes |
| Comparative Example 3 | — | | | 19.0 | 75 | No |
| Example 17 | — | | | 19.0 | 75 | No |
| Example 18 | — | | | 20.0 | 75 | Yes |
| Example 19 | — | | | 20.0 | 75 | Yes |
| Example 20 | — | | | 20.0 | 75 | Yes |
| Comparative Example 4 | Oxygen-deficient tungsten-doped tin oxide | 600 | | 20.0 | 75 | Yes |
| Example 21 | Oxygen-deficient tungsten-doped tin oxide | 600 | 50 | 8.0 | 54 | Yes |
| Example 22 | Oxygen-deficient tungsten-doped tin oxide | 600 | 50 | 8.0 | 54 | Yes |

| | Number of fine particles | Detected metal element amount A atomic % | Average major-axis length B nm | Density gradient | Presence or absence of resin E |
|---|---|---|---|---|---|
| Example 1 | 3 | 9.1 | 530 | Presence | Presence |
| Example 2 | 3 | 4.6 | 450 | Presence | Presence |
| Example 3 | 3 | 0.1 | 580 | Presence | Presence |
| Example 4 | 3 | 7.1 | 550 | Presence | Presence |
| Example 5 | 3 | 12.4 | 560 | Presence | Presence |
| Example 6 | 3 | 17.6 | 380 | Presence | Presence |
| Example 7 | 3 | 17.6 | 250 | Presence | Presence |
| Example 8 | 3 | 7.8 | 506 | Presence | Presence |
| Example 9 | 3 | 8.5 | 430 | Presence | Presence |
| Example 10 | 1 | 6.6 | 310 | Presence | Presence |
| Example 11 | 2 | 6.3 | 510 | Absence | Presence |
| Example 12 | 3 | 7.2 | 515 | Absence | Presence |
| Comparative Example 1 | 2 | 3.8 | 511 | Presence | Presence |
| Example 13 | 2 | 4.1 | 510 | Presence | Presence |
| Example 14 | 2 | 14.5 | 705 | Presence | Presence |
| Example 15 | 3 | 16.0 | 703 | Presence | Presence |
| Example 16 | 2 | 19 | 780 | Presence | Presence |
| Comparative Example 2 | 3 | 21.0 | 790 | Presence | Presence |
| Comparative Example 3 | 2 | 5.9 | 90 | Presence | Presence |
| Example 17 | 2 | 5.8 | 105 | Presence | Presence |
| Example 18 | 2 | 5.3 | 593 | Presence | Presence |
| Example 19 | 2 | 5.2 | 650 | Presence | Presence |
| Example 20 | 2 | 4.9 | 800 | Presence | Presence |

TABLE 3-continued

| | | | | | |
|---|---|---|---|---|---|
| Comparative Example 4 | 3 | 4.8 | 900 | Presence | Presence |
| Example 21 | 3 | 9.1 | 527 | Presence | Absence |
| Example 22 | 3 | 9.1 | 530 | Presence | Presence |

Each of the developers was used for image evaluation with RICOH Pro C6003 manufactured by Ricoh Company, Ltd.

<Evaluation of Carrier Adhesion (Solid Portion)>

Each of the developers 1 to 26 of the Examples and the Comparative Examples was used for image printing on 60,000 or 100,000 A3 sheets (image area percentage: 0.5%). Thereafter, the developer was evaluated for carrier adhesion under the conditions described below.

Carrier adhesion causes scratches on a photoconductor drum or a fixing roller, and leads to poor image quality. Even if carrier adhesion occurs on a photoconductor, only some carrier particles are transferred onto a paper sheet. Thus, the evaluation was performed as follows.

After image printing on 60,000 or 100,000 A3 sheets, a solid image was formed under predetermined developing conditions (charged potential (Vd):—600 V, potential after exposure of an image portion (solid portion):—100 V, developing bias: DC—500 V), and the image formation was intermitted by turning off the power source. For the evaluation, the number of carrier particles adhering to the photoconductor was counted after image transfer. A region of 10 mm×100 mm on the photoconductor was used for evaluation. A failing grade was given if the number of adhering carrier particles was 100/A3 or more.

<Evaluation of Toner Scattering>

For evaluation of toner scattering, the side surface of a developing unit was visually observed after image printing on 60,000 or 100,000 A4 sheets (image area percentage: 20%). As illustrated by symbols A (very good), B (good), C (usable), and D (unusable) in Table 4, the evaluation was performed on the basis of the following criteria:

Very good: no toner scattering in the entire developing unit;

Good: toner smear on the developing unit, but no toner scattering to the outside of the apparatus;

Usable: toner smear on the developing unit and a filter, but no toner scattering to the outside of the apparatus; and Unusable: toner scattering to the outside of the apparatus.

The results are illustrated in Table 4.

TABLE 4

| | | | | Evaluation of carrier adhesion (solid portion) (particles/A3) | | Evaluation of toner scattering | |
|---|---|---|---|---|---|---|---|
| | Carrier | Toner | Developer | 0.5% 100,000 sheets | 0.5% 60,000 sheets | 20% 100,000 sheets | 20% 60,000 sheets |
| Example 1 | Carrier 1 | Toner 1 | Developer 1 | 27 | 4 | Very good | Very good |
| Example 2 | Carrier 2 | Toner 1 | Developer 2 | 68 | 17 | Very good | Very good |
| Example 3 | Carrier 3 | Toner 1 | Developer 3 | 34 | 6 | Very good | Very good |
| Example 4 | Carrier 4 | Toner 1 | Developer 4 | 27 | 7 | Very good | Very good |
| Example 5 | Carrier 5 | Toner 1 | Developer 5 | 26 | 7 | Very good | Very good |
| Example 6 | Carrier 6 | Toner 1 | Developer 6 | 8 | 6 | Very good | Very good |
| Example 7 | Carrier 7 | Toner 1 | Developer 7 | 7 | 5 | Good | Very good |
| Example 8 | Carrier 8 | Toner 1 | Developer 8 | 30 | 8 | Very good | Very good |
| Example 9 | Carrier 9 | Toner 1 | Developer 9 | 29 | 5 | Very good | Very good |
| Example 10 | Carrier 10 | Toner 1 | Developer 10 | 42 | 12 | Good | Very good |
| Example 11 | Carrier 11 | Toner 1 | Developer 11 | 50 | 20 | Usable | Good |
| Example 12 | Carrier 12 | Toner 1 | Developer 12 | 50 | 19 | Usable | Good |
| Comparative Example 1 | Carrier 13 | Toner 1 | Developer 13 | 390 | 210 | Unusable | Unusable |
| Example 13 | Carrier 14 | Toner 1 | Developer 14 | 70 | 19 | Very good | Very good |
| Example 14 | Carrier 15 | Toner 1 | Developer 15 | 10 | 5 | Very good | Very good |
| Example 15 | Carrier 16 | Toner 1 | Developer 16 | 10 | 10 | Good | Very good |
| Example 16 | Carrier 17 | Toner 1 | Developer 17 | 10 | 5 | Very good | Very good |
| Comparative Example 2 | Carrier 18 | Toner 1 | Developer 18 | 320 | 180 | Unusable | Usable |
| Comparative Example 3 | Carrier 19 | Toner 1 | Developer 19 | 40 | 10 | Unusable | Unusable |
| Example 17 | Carrier 20 | Toner 1 | Developer 20 | 40 | 11 | Usable | Good |
| Example 18 | Carrier 21 | Toner 1 | Developer 21 | 60 | 16 | Very good | Very good |
| Example 19 | Carrier 22 | Toner 1 | Developer 22 | 58 | 14 | Good | Very good |
| Example 20 | Carrier 23 | Toner 1 | Developer 23 | 59 | 10 | Good | Very good |
| Comparative Example 4 | Carrier 24 | Toner 1 | Developer 24 | 220 | 151 | Unusable | Usable |
| Example 21 | Carrier 25 | Toner 1 | Developer 25 | 40 | 16 | Good | Very good |
| Example 22 | Carrier 1 | Toner 2 | Developer 26 | 30 | 5 | Good | Very good |

The results illustrated in Table 4 show that the developer according to an embodiment of the present invention is superior to the comparative developer in terms of carrier adhesion (solid portion) and toner scattering. Therefore, according to an embodiment of the present invention, a carrier is provided which achieves improvements in image quality and durability, which enables reliable supply of a developer to a developing region, which has an excellent ability to prevent toner spent, and which enables continuous paper feeding at a printing density of low image area percentage in a high-speed machine using a low-temperature fixing toner.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A carrier comprising:

a core particle which is magnetic; and a resin layer coating a surface of the core particle, the resin layer comprising fine metal particles which comprise at least one selected from the group consisting of titanium oxide, barium sulfate, tungsten-doped tin oxide, lithium ferrite, magnesium hydroxide, and MnZn ferrite, wherein a detected metal element amount A obtained by X-ray photoelectron spectrometry of the surface of the carrier is in a range of 4.0 atomic %≤A≤20.0 atomic % and an average major-axis length B of the fine metal particles exposing from the resin layer is in a range of 100 nm≤B≤800 nm, and the X-ray photoelectron spectrometry is conducted by specifying the elements to be detected, detecting a peak for each element, and calculating the metal element amount A based on the peak.

2. The carrier according to claim 1, wherein the detected metal element amount A is in a range of 4.0 atomic %≤A≤15.0 atomic %.

3. The carrier according to claim 1, wherein the average major-axis length B is in a range of 100 nm≤B≤600 nm.

4. The carrier according to claim 1, wherein a density of the fine metal particles in the resin layer is set so as to increase outward from a side of the core particle.

5. The carrier according to claim 1, wherein the fine metal particles comprise two or more different types of fine metal particles; and fine metal particles having a particle size D of a range of 400 nm≤D≤1,000 nm account for 30 mass % or more of all the fine metal particles.

6. The carrier according to claim 1, wherein the resin layer comprises an inner layer and an outer layer, and the fine metal particles are included mainly in the outer layer.

7. A developer comprising:

the carrier according to claim 1; and a toner.

8. A supplemental developer comprising:

the carrier according to claim 1; and a toner in an amount of from 2 to 50 parts by mass relative to 1 part by mass of the carrier.

9. An image forming apparatus comprising:

an electrostatic latent image bearer;

a charging unit configured to charge the electrostatic latent image bearer;

an exposure unit configured to form an electrostatic latent image on the electrostatic latent image bearer;

a developing unit comprising the developer according to claim 7, configured to develop the electrostatic latent image with the developer to form a toner image;

a transfer unit configured to transfer the toner image formed on the electrostatic latent image bearer onto a recording medium; and a fixing unit configured to fix the transferred toner image on the recording medium.

10. An image forming method comprising:

forming an electrostatic latent image on an electrostatic latent image bearer;

developing the electrostatic latent image using the developer according to claim 7 to form a toner image;

transferring the toner image formed on the electrostatic latent image bearer onto a recording medium; and fixing the transferred toner image on the recording medium.

11. A process cartridge comprising:

an electrostatic latent image bearer;

a charging unit configured to charge a surface of the electrostatic latent image bearer;

a developing unit comprising the developer according to claim 7, configured to develop an electrostatic latent image formed on the electrostatic latent image bearer with the developer; and a cleaning unit configured to clean the electrostatic latent image bearer.

* * * * *